US005917517A

United States Patent [19]

Kida et al.

[11] Patent Number: 5,917,517

[45] **Date of Patent: *Jun. 29, 1999**

[54] INK JET RECORDING APPARATUS AND WIPING METHOD USED FOR SUCH APPARATUS

[75] Inventors: Akira Kida, Yokohama; Soichi Hiramatsu, Hachioji; Hideki Yamaguchi; Hiroyuki Inoue, both of Yokohama; Takashi Nojima, Mitaka; Hitoshi Nakamura, Yokohama; Hideaki Kawakami, Yokohama; Takeshi Iwasaki, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/603,376

[22] Filed: Feb. 20, 1996

[30] Foreign Application Priority Data

Feb. 21, 1995 [JP] Japan ..... 7-031922

[51] Int. Cl.[6] ..... B41J 2/165

[52] U.S. Cl. ..... 347/33

[58] Field of Search ..... 347/20, 22, 33

[56] References Cited

U.S. PATENT DOCUMENTS

| | | | |
|---|---|---|---|
| 4,951,066 | 8/1990 | Terasawa et al. | 346/140 R |
| 4,959,673 | 9/1990 | Noda | 346/140 R |
| 4,967,204 | 10/1990 | Terasawa et al. | 346/1.1 |
| 5,053,787 | 10/1991 | Terasawa et al. | 346/1.1 |
| 5,126,765 | 6/1992 | Nakamura | 347/33 |
| 5,138,343 | 8/1992 | Aichi et al. | 346/140 R |
| 5,148,203 | 9/1992 | Hirano | 346/140 R |
| 5,153,613 | 10/1992 | Yamaguchi et al. | 346/140 R |
| 5,182,582 | 1/1993 | Okamura | 347/33 |
| 5,396,277 | 3/1995 | Gast et al. | 347/33 |
| 5,486,850 | 1/1996 | Nakamura | 347/24 |
| 5,539,435 | 7/1996 | Uchida et al. | 347/33 |
| 5,581,282 | 12/1996 | Okamura | 347/33 |
| 5,606,354 | 2/1997 | Bekki et al. | 347/33 |

FOREIGN PATENT DOCUMENTS

| | | | |
|---|---|---|---|
| 0 423 475 | 4/1991 | European Pat. Off. | B41J 2/165 |
| 0 494 693 | 7/1992 | European Pat. Off. | B41J 2/165 |
| 0 589 604 | 3/1994 | European Pat. Off. | B41J 2/165 |
| 40 00 414 | 7/1991 | Germany | B41J 2/165 |
| 62-251146 | 10/1987 | Japan | B41J 3/04 |
| 3-19847 | 1/1991 | Japan | B41J 2/165 |
| 3-153360 | 7/1991 | Japan | B41J 2/165 |

*Primary Examiner*—Adolf Deneke Berhane
*Attorney, Agent, or Firm*—Fitzpatrick, Cella, Harper & Scinto

[57] ABSTRACT

An ink jet recording apparatus comprises a carriage for causing a recording head provided with discharge ports for discharging ink to travel by mounting the recording head on the carriage, a wiping member for wiping the discharge port surface of the recording head having the discharge ports arranged therefor, and holding means for rotatively holding the wiping member in the traveling direction of the carriage at the time of the discharge port surface being wiped by means of the wiping member. With this arrangement, ink adhering to the leading end of the wiping member is prevented from flying and spreading to stain the recording area of a recording material, thus keeping the quality of printed images thereon.

15 Claims, 8 Drawing Sheets

INK JET RECORDING APPARATUS AND WIPING METHOD USED FOR SUCH APPARATUS

BACKGROUND OF THE INVENTION

1. Field of the Invention

The present invention relates to an ink jet recording apparatus for recording by discharging ink to a recording medium.

2. Related Background Art

A recording apparatus provided with the functions of a printer, copying machine, facsimile, and the like or a recording apparatus used as an output equipment for a complex electronic apparatus or a work station including a computer, word processor, and the like, is structured to record images on a sheet paper, thin plastic sheet, or some other recording material (recording medium). These recording apparatuses can be classified into an ink jet type, wire-dot type, thermal type, laser beam type, and others depending on the recording methods adopted for them, respectively.

Generally, with the recording apparatus of the serial type that adopts a serial scanning method for performing the main scan in the direction substantially perpendicular to the feeding direction (sub-scanning direction) of a recording material, images are recorded on the recording material in the main scanning direction by causing a carriage having a recording head, serving as recording means, mounted on it to travel on the recording material after the recording material has been set at a given recording position.

Then, when a recording on one line portion is completed, a sheet feeding (pitch feed) is performed for a given amount. After that, the recording of images is resumed in the main scanning direction for the next line of the recording material the movement of which has been suspended until then.

By repeating the operation described above, the recording is executed on the entire area of the recording material.

Of the recording apparatuses, its possible to obtain the advantages given below by adapting a recording apparatus of an ink jet type (an ink jet recording apparatus) that records on a recording material by discharging ink from the recording head serving as recording means.

(1) Recording means can be fabricated compactly with ease.

(2) Highly precise images can be recorded at high speeds.

(3) Recording can be performed on an ordinary paper without any particular treatment given thereto.

(4) Running costs are low.

(5) Being non-impact type, the apparatus can operate with a lesser amount of noises.

(6) Color images can be recorded with ease by use of multiple color ink.

Also, for the recording apparatus of a line type that uses a line type recording head provided with many numbers of discharge ports arranged therefor in the sub-scanning direction with respect to a recording material, the recording speeds can be enhanced more.

Of the ink jet recording apparatuses described above, recording means (recording head) of an ink jet type that discharges ink by the utilization of thermal energy can be formed easily to provide a highly densified arrangement of liquid paths (arrangement of discharge ports) by the film formation applied to the provision of electrothermal transducing elements, electrodes, walls of liquid paths, ceiling, and others on a base board by means of etching, deposition, sputtering, and other processes of semiconductor fabrication. Also, by making the most of the IC technologies and micro-machining techniques, it is easy to implement the elongation and surfacing (two-dimensional processing) of recording means, hence easily implementing the fully multiple recording means as well as its highly densified assembly.

Meanwhile, there are various demands on the materials of recording media. In recent years, it has been requested to provide a perforated continuous sheet, and paper sheets that have been prepared in arbitrary shapes for use, in addition to the paper sheet usually adopted for recording.

When using the ink jet recording apparatus described above, there are some cases where defective discharges (including disabled ones) are caused due to clogging of the discharge ports if paper particles, dust particles, or other foreign substances adhere to the ink discharge .ports of the recording head or if ink in the discharge ports are dried to become overly viscous or solidified therein. Therefore, in order to prevent the discharge ports from being clogged, a recovery device is adopted for closing the ink discharge ports of the recording head by means of a cap when recording is at rest, and sucking ink from the discharge ports at the same time by suction means such as a pump (not shown) through the cap, thus maintaining the discharge ports in good condition. Here, in case of the ink jet recording apparatus of the serial type described above, the closing operation (capping operation) by means of the cap is executed in such a manner that the recording head is driven to the capping position arranged in a location out of the recording area, and then, the cap and ink discharge ports are caused to be in contact with each other in the capping portion thus arranged.

Also, the ink jet recording apparatus described above is provided with cleaning means for removing foreign substances adhering to the ink discharge ports (the discharge port formation surface) of the recording head. As one example of such cleaning means, there is adopted a mechanism that wipes and cleans the discharge port formation surface of the recording head by use of a flexible wiper blade (wiping member).

FIG. 11 is a perspective view which shows the structure of the principal part of a generally used ink jet recording apparatus provided with a suction recovery device.

The ink jet recording apparatus shown in FIG. 11 is provided mainly with a recording head 501, serving as recording means, having a plurality of discharge ports to discharge ink droplets by use of energy generating means (such as piezoelectric elements, heat generating resistors) incorporated in the recording head; a carriage 502 that mounts the recording head 501 on it and reciprocates in the main scanning direction; a carriage guide shaft 503 that supports carriage 502 slidably; a feed roller 505 that carries (feeds) a recording material 504 in accordance with recording conditions; a pulse motor 506 that serves as driving sources of the feed roller 505 and an automatic sheet feeder (not shown); a pump carriage 507 that mounts a cap unit to cover (close) the discharge port surface of the recording head 501, which is capable of traveling in parallel to the carriage guide shaft 503; a pump guide shaft 508 that guides the pump carriage 507 to effectuate its parallel traveling; and a returning spring 509 that biases the pump carriage 507 to the right-hand side in FIG. 11. Also, an arm section 507*a* is provided for the pump carriage 507, and an insertion hole 507*b* is arranged on the leading end of the arm to receive an extrusion 502*a* installed on the right side face of the carriage 502. With this structure, the extrusion 502*a* is inserted into the hole 507*b* when the carriage 502 travels to the left side in FIG. 11 so as to allow the cap 510 to abut upon the discharge port surface of the recording head 501 under pressure. In this way, the carriage guide shaft 503 checks the rotation of the carriage 502 around this shaft.

With the structure described above, the carriage 502 travels in the direction from the right to left side in FIG. 11. Then the arm section 507*a* is pressed strongly by the carriage 502 to cause the pump carriage 507 to travel in the direction to the left side along the pump guide shaft. In this way, the rear portion of the cap 510 installed on the pump carriage 507 engages with the rail 511, and then, the cap 510 approaches the discharge port surface of the recording head 501 and abuts upon the surface under pressure as the cap 510 shifts more to the left side by means of the rail 511 formed to be increasingly buckled forward to the front side as it extends to the left side. In other words, when the carriage 502 travels, the cap 510 installed on the pump carriage 507 shifts to the left end portion. Then, due to the configuration of the rail 511 thus formed, the cap 510 is allowed to close the recording head 501 (cause it to be in the capping state).

When the pulse motor 506 is driven in this capping state, a pump cam 513 is driven through a pump gear 512. Further, by means of the pump cam 513, the piston of the pump 514 is driven (thus driving the pump 514). Also, a tube 515 is connected to the pump 514 though a joint. The tube 515 is connected to the interior of the cap 510. As a result, when the pump 514 is driven, while the recording head 501 is positioned in the left end portion, ink is sucked from the discharge ports of the recording head 501 through the tube 515 and cap 510 for the execution of the recovery operation.

Also, in FIG. 11, the wiper (wiping member) 516 for wiping the discharge port surface of the recording head 501 is installed in the location slightly protruding to the traveling path of the recording head 501: such location is on the right side of the pump carriage 507 and on the left side of the feeding path of a recording material 504.

In this way, when the carriage 502 travels to the left side of the feeding path of the recording material 504 to push the pump carriage 507, the discharge port surface (ink discharging portion) of the recording head 501 is being wiped by means of the wiping member 516. Also, when the carriage 502 travels to the recording material 504 side from the pump carriage 507 side, that is, it travels from the left side portion to the right-hand side, the discharge port surface of the recording head 501 is wiped by means of the wiping member 516.

However, for the conventional ink jet recording apparatus described above, the arrangement is made to keep the wiping member always in a state that it is protruded to the traveling path of the recording head. Therefore, when the carriage reciprocates, the discharge port surface of the recording head is wiped each time it travels to the left side or to the right side: the wiping operation is executed twice a reciprocation of the carriage inevitably. Also, in a case of the predischarge that discharges ink into the cap from the recording head without executing any capping, the wiping operation is inevitably performed. This means that the wiping operation is executed even when there is no need for it. Hence, a higher possibility of defective discharges may be brought about by the wiping operation itself or there is a problem of the surface degradation due to wearing of the discharge port surface of the recording head or there occurs the surface degradation of the wiping member or the earlier surface degradation thereof, among some others.

Here, it is conceivable to provide a special driving system so that the wiping member can be protruded or detracted as required. However, the provision of such special driving system results in a significant increase of costs eventually.

Besides this conception, there has been proposed a method for solving the problem described above in such a manner that with the provision of a sliding member that travels in the non-recording area along the traveling of a carriage in the non-recording area, a capping member and a wiping member are arranged to advance to the recording means side and part them from the recording means by utilizing the slanted face formed on the front side of the sliding member, and then, being interlocked with the traveling of the recording means in the same direction in which the wiping has been performed, the wiping member is caused to retract after wiping the ink discharge port surface of the recording means. In this way, the dimension of the non-recording area is made smaller in the width direction as a solution of such problem as described above.

Nevertheless, in accordance with the structure described above, the curved blade of the wiping member is restored to its original shape by the function of its own elasticity the moment it is parted from the recording means. Therefore, ink adhering to the leading end of the wiping member is also parted and caused to spread therefrom by the restoring force of the blade. In this case, the direction in which ink is caused to fly and spread is toward the recording area. Therefore, a problem is encountered that the spread ink adheres to the recording area of a recording material, leading to the degradation of the quality of printed images.

SUMMARY OF THE INVENTION

The present invention is designed in consideration of the problems encountered in the prior art described above. It is an object of the invention to provide an ink jet recording apparatus capable of wiping the discharge port surface of recording means without causing stains to adhere to a recording material, while keeping the width dimension of the apparatus small as a whole without any extra costs, and also, to provide a wiping method used for such apparatus.

It is another object of the invention to provide an ink jet recording apparatus comprising a carriage that causes a recording head provided with discharge ports for discharging ink to travel by mounting it on the carriage; a wiping member for wiping the discharge port surface of the recording head where the aforesaid discharge ports are arranged; and holding means for rotatively holding the wiping member in the traveling direction of the carriage at the time of the discharge port surface being wiped by means of the wiping member.

It is still another object of the invention to provide a wiping method used for an ink jet recording apparatus provided with a recording head having discharge ports for discharging ink, the discharge port surface of the recording head, where the aforesaid discharge ports are arranged, being wiped by a wiping member. This method comprises the step of parting the aforesaid wiping member from the recording head when the wiping member rotates in the traveling direction of the recording head at the time of the discharge port surface being wiped by means of the wiping member.

In accordance with the present invention structured as described above, the wiping member serving as wiping means is parted from the recording head by the application of a control effectuated along the traveling operation of the carriage after cleaning the recording head, while the member being allowed to rotate in the traveling direction of the carriage having the recording head on it, and after that, the wiping member is restored to the initial position of cleaning position without abutting upon the recording head. Therefore, ink does not fly and spread in the direction of the printing area the moment the wiping member is parted from the recording head. There is no possibility that the quality of printed images is degraded by the adhesion of ink to the recording area of the recording material.

DETAILED DESCRIPTION OF THE PREFERRED EMBODIMENTS

Hereinafter, with reference to the accompanying drawings, the description will be made of the embodiments in accordance with the present invention.

Figure 1:
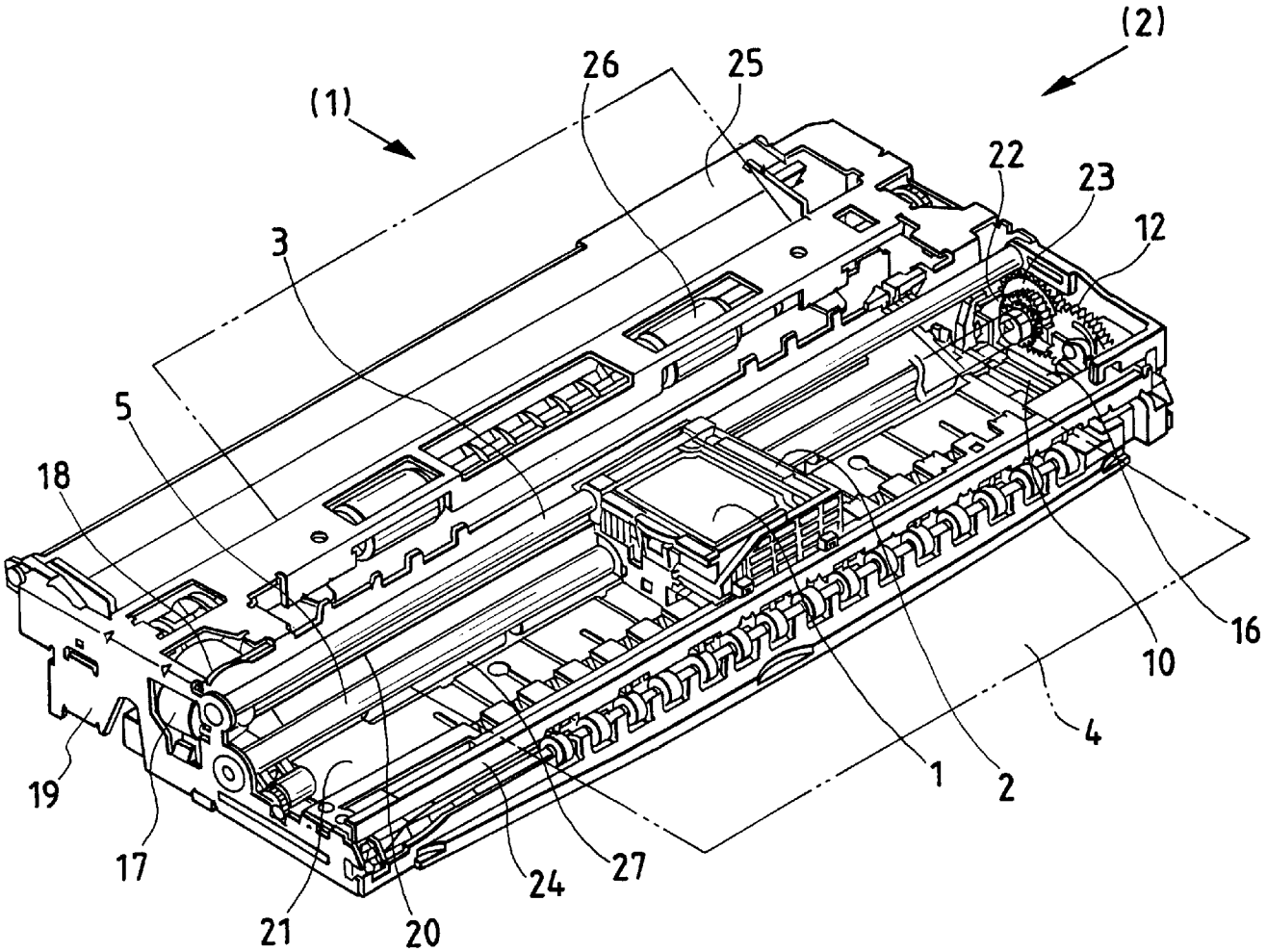
FIG. 1 is a perspective view which schematically shows the brief structure of one embodiment of an ink jet recording apparatus to which the present invention is applicable.

FIG. 1 is a perspective view schematically showing one embodiment of an ink jet recording apparatus to which the present invention is applicable.

The ink jet recording apparatus shown in FIG. 1 is provided at least with a pickup roller 26, a feed roller 5 and a pinch roller 27 for carrying a recording material 4; a recording head 1 serving as recording means for recording on the recording material 4; a carriage 2 having the recording head 1 mounted on it; a carriage guide shaft 3 and a guide rail 24, both ends of which are fixed to a frame 19, for slidably supporting the carriage 2 in the direction rectangular to the feeding direction of the recording material 4, and in the direction parallel to the surface of the recording material 4; a carriage driving belt 20 for driving the carriage 2 to reciprocate in the straight direction; a carriage motor 17 and a driving pulley 18; and a pressure board 25 and a base 21.

The recording head 1 is an exchangeable ink jet recording head formed together with an ink tank or to be separable from an ink tank, and provided with electrothermal transducing elements to discharge ink from the discharge ports for recording by the utilization of pressure changes created by the development and contraction of air bubbles generated by film boiling when thermal energy is applied.

The pinch roller 27 is biased to the feed roller 5 by means of a spring (not shown) to generate force to carry the recording material 4.

Also, a wiping member (wiper) 16, a member to wipe the recording head 1, and a cap 10, a member to cap the recording head, are arranged in a location out of the recording area, while an LF gear 23 for transmitting the power of a feed motor (not shown) to the feed roller 5 is installed on one end of the feed roller 5. Further, there are installed a trigger gear 22 and a pump gear 12 for transmitting the power from the LF gear 23 to the recovery device.

Hereunder, the description will be made of the printing operation performed by means of the structure described above with respect to the recording material 4.

The printing material 4 is stacked on the pressure board 25 before printing. At this juncture, the pressure board 25 is in a state that it is away from the pickup roller 26 by the function of a release cam (not shown) arranged for the shaft installed on the pickup roller 26.

When the recording material 4 is set, the driving force of the feed roller 5 is transmitted to the pickup roller 26 and release cam through gears (not shown). Then the release cam is parted from the pressure board 25 to raise the pressure board 25. The pickup roller 26 and the recording material 4 are in contact with each other. Thus, along the rotation of the pickup roller 26, the recording material 4 is drawn in to be carried to a position opposite to the ink discharge port surface of the recording head 1. Here, the carriage driving motor 17 is driven to cause the carriage driving belt 20 to rotate. The carriage 2 reciprocates in the straight direction along the carriage guide shaft 3 and guide rail 24. At the same time, the recording head 1 mounted on the carriage 2 discharges ink onto the recording material 4 in accordance with recording signals in order to record the contents to be recorded on the recording material.

If paper particles, dust, or any other foreign substances should adhere to the ink discharge portion of the recording head 1 or ink in the discharge portion is dried to become overly viscous or solidified, clogging takes places in the discharge ports, causing defective discharges (including disabled discharges) in some cases. Therefore, in order to prevent such clogging, the ink discharge ports of the recording head 1 are closed by means of the cap 10 when recording is at rest. At the same time, the recovery device is used to implement the recovery of the discharge ports by sucking ink from the discharge ports through the cap 10 by use of a pump (not shown) or other suction means. In this respect, for the ink jet recording apparatus described above, the closing operation (capping operation) by means of the cap 10 is performed in such a manner that the recording head 1 is driven to travel to the capping position arranged in a location out of the recording area, and then, the cap 10 is allowed to abut upon the ink discharge portion in such capping position. Here, in accordance with this structure, the driving force to allow the cap 10 to abut upon such portion is transmitted to the cap 10 from a motor (not shown) through the LF gear 23 and pump gear 12, but usually, the LF gear 23 and pump gear 12 are not in a state of engaging with each other. Therefore, when a capping is executed, the switch-over of driving is performed by depression caused by the carriage to interlock the trigger gear 22 and pump gear 12 through a configuration (not shown). In other words, the trigger gear 22 is depressed by means of the carriage 2 to allow the LF gear 23 and trigger gear 22 to be in contact with each other. The driving force of the LF gear 23 is then transmitted to the pump gear 12 through the trigger gear 22, thus making interlocking possible between them.

Figure 2:
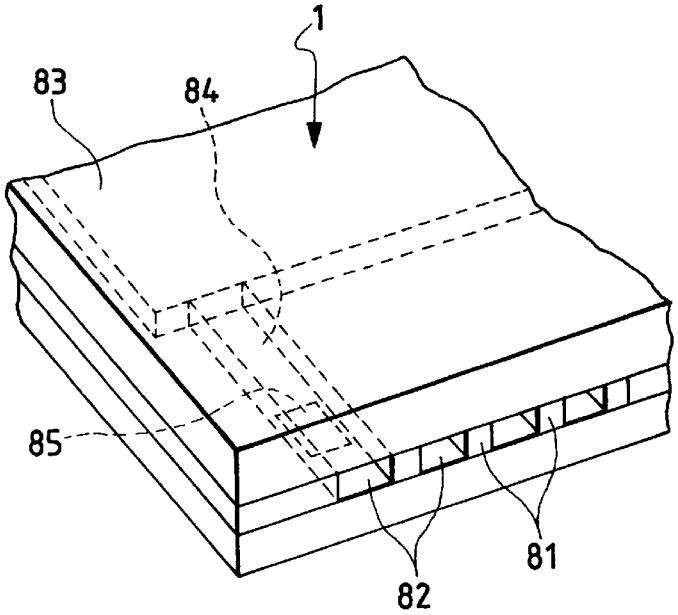
FIG. 2 is a partial perspective view schematically showing the structure of the ink discharge unit of a recording head.

FIG. 2 is a partial perspective view schematically showing the structure of the ink discharge portion of a recording head.

In FIG. 2, a plurality of discharge ports 82 are formed at specific pitches on the discharge port surface 81 facing the recording material 4 (see FIG. 1) with a given gap (approximately 0.5 to 2.00 mm, for example), and electrothermal transducing elements (heat generating resistors and others) 85 are arranged to generate energy used for discharging ink along each of the wall faces of liquid paths 84 that connect each discharge port with a common liquid chamber 83. The recording head 1 is mounted on the carriage 2 (see FIG. 1) to form a positional relationship with the carriage so that each of the discharge ports 82 is arranged in the direction intersecting the main scanning direction (the direction in which the recording head 1 reciprocates).

With the structure described above, the corresponding electrothermal transducing elements are driven (energized) in accordance with image signals or discharge signals. Then film boiling is created in ink in each liquid path 84. By the pressure exerted at that time, ink is discharged from each of the discharge ports 82.

Figure 3:
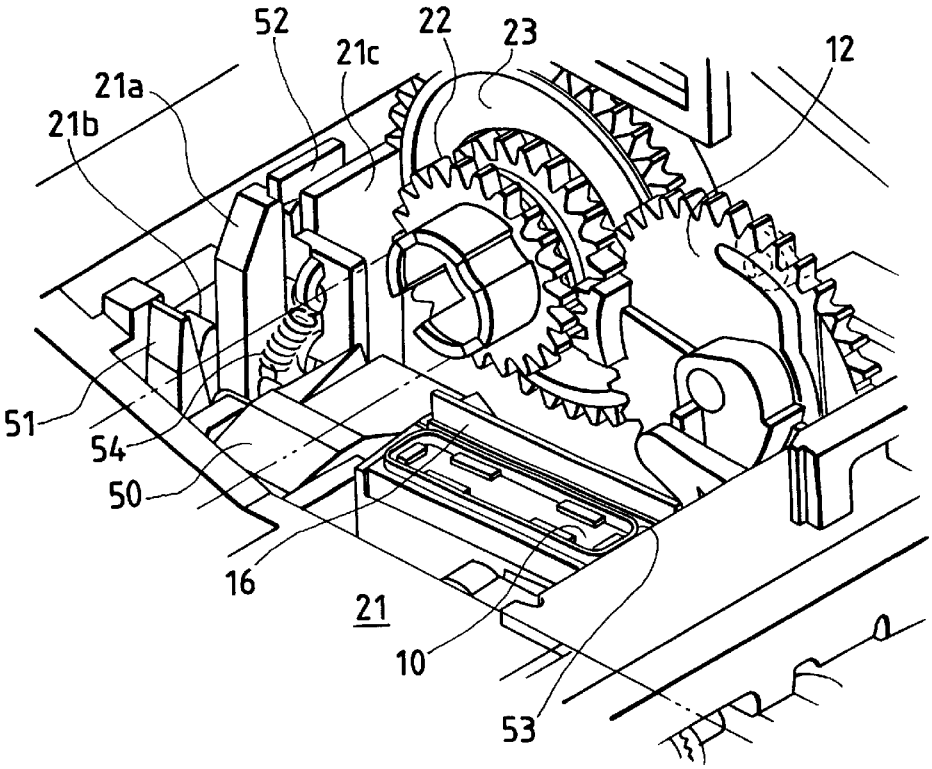
FIG. 3 is an enlarged perspective view which shows the wiping mechanism unit of the ink jet recording apparatus represented in FIG. 1.
Figure 4:
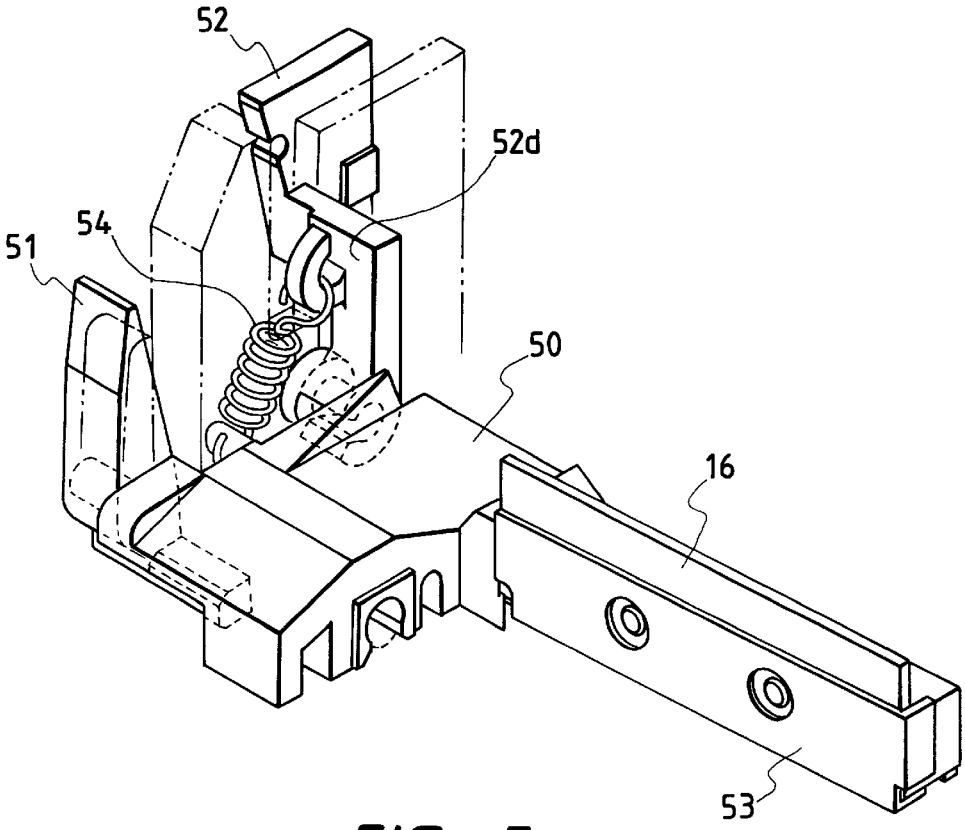
FIG. 4 is an enlarged perspective view which shows only the wiping mechanism of the ink jet recording apparatus represented in FIG. 1.
Figure 5:
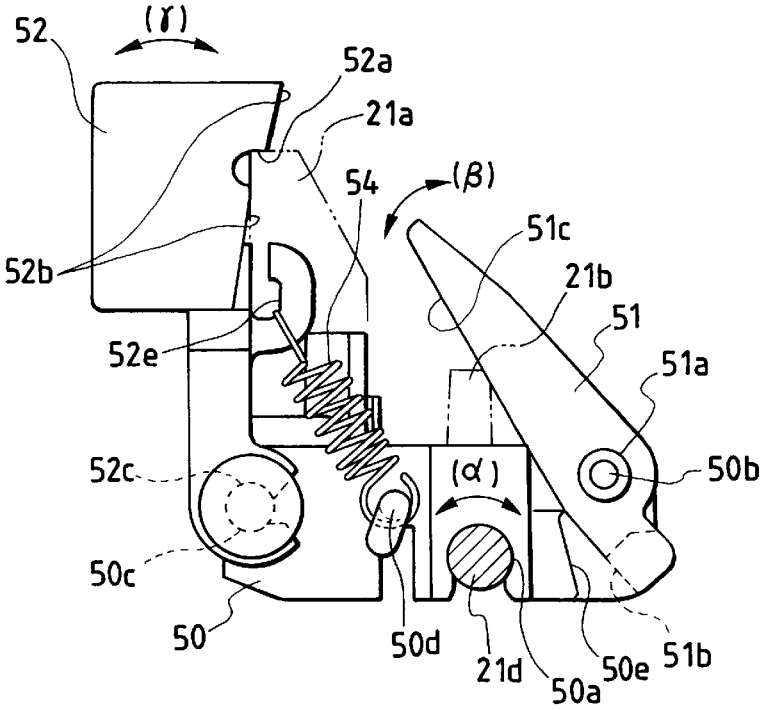
FIG. 5 is a rear view of the wiping mechanism of the ink jet recording apparatus shown in FIG. 1 observed in the direction indicated by an arrow (1) in FIG. 1.
Figure 6:
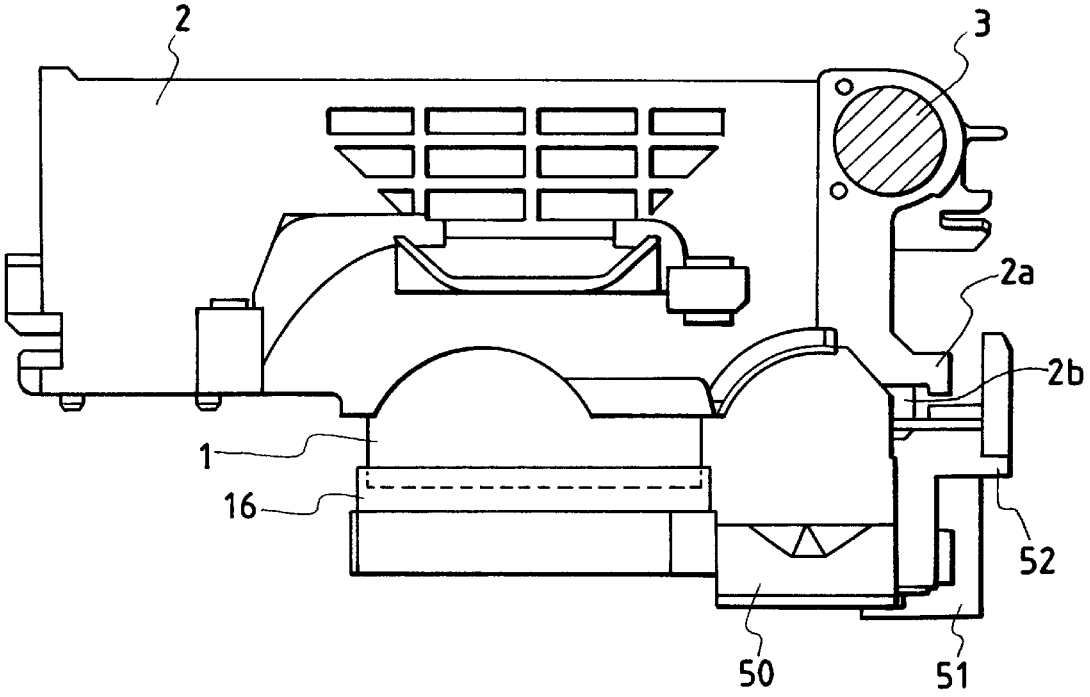
FIG. 6 is a side view of the ink jet recording apparatus shown in FIG. 1 observed in the direction indicated by an arrow (2) in FIG. 1.

FIG. 3 is an enlarged perspective view which shows the wiping mechanism unit of an ink jet recording apparatus represented in FIG. 1. FIG. 4 is an enlarged perspective view which shows only the wiping mechanism. FIG. 5 is a rear view of the wiping mechanism of the ink jet recording apparatus represented in FIG. 1, observed in the direction indicated by an arrow (1) in FIG. 1. FIG. 6 is a side view of the ink jet recording apparatus shown in FIG. 1, observed in the direction indicated by an arrow (2) in FIG. 1.

In FIG. 3, the wiper 16 is installed on a wiper holder 50. The direction of its installation is substantially perpendicular to the discharge port surface 81 (see FIG. 2) of the recording head 1. Also, a wiper cover 53 is arranged in order to prevent the falling off of the wiper 16 from the wiper holder 50.

In FIG. 5, the wiper holder 50 is rotatively installed in the direction indicated by an arrow (a), that is, the scanning direction of the carriage 21, by means of the fitting relationship between a rotational shaft bearing 50*a* and the rotational shaft 21*d* provided for the base 21 (see FIG. 3). Then, the structure is arranged to allow the wiper 16 (see FIG. 4) to abut upon or part from the discharge port surface 81 (see FIG. 2) and discharge ports 82 (also, see FIG. 2) by the rotation of the wiper holder 50.

Also, on the wiper holder 50, a latch lever 52 for determining the entering amount of the recording head 1 (see FIG. 2) and the wiper 16 (see FIG. 4) is rotatively installed in the direction indicated by an arrow (γ) in FIG. 5, that is, the scanning direction of the carriage 22 by the fitting relationship between the latch lever rotational shaft 50*c* of the wiper holder 50 and the rotational shaft bearing 52*c* of the latch lever 52. Here, the entering amount of the carriage 2 (see FIG. 1) is determined by hooking the hook portion 52*a* of the latch lever 52 to the latch portion 21*a* of the base 21 (see FIG. 3). Further, in order to prevent the falling off of the latch lever 52 from the latch portion 21*a* of the base 21, a latch spring 54 is tensioned between the spring hook portion 52*e* of the latch lever 52 and the spring hook portion 50*d* of the wiper holder 50 so that the hook portion 52*a* and guide unit 52 are in contact with the latch portion 21*a* of the base 21 under pressure.

The wiper 16 (see FIG. 4) is parted from the recording head 1 (see FIG. 1) when the latch lever abutting arm 2*b* (see FIG. 6) installed on the carriage 2 (see FIG. 2) is in contact with the abutting portion 52*d* (see FIG. 4) of the latch lever 52. In other words, when the latch lever abutting arm 2*b* (see FIG. 6) is in contact with the abutting portion 52*d* (see FIG. 4) of the latch lever, the hook portion 52*a* of the latch lever 52 is released from the latch portion 21*a* of the base 21. Then, the downward component of the force that the latch lever 52 receives by the biasing force of the latch spring 54 is transferred to the fitting portions 52*c* and 50*c* of the latch lever 52 and wiper holder 50. By the exertion of this force, the wiper holder 50 is provided with a rotational moment centering on the rotational shaft bearing 50*a*. Hence the wiper holder 50 rotates, and in turn, the wiper 16 (see FIG. 3) installed on the wiper holder 50 rotates to part from the recording head 1 (see FIG. 1).

Further, a resetting lever 51 is provided for the wiper holder 50 to restore the original state of wiper 16 (see FIG. 3) from the state where it is parted from the recording head 1 (see FIG. 1). The resetting lever 51 is rotatively installed in the direction indicated by an arrow (β) in FIG. 5, that is, the scanning direction of the carriage 22 by the fitting relationship between the rotational shaft bearing 51*a* and the rotational shaft 50*b* installed on the wiper holder 50.

When the latch lever 52 in the state shown in FIG. 5 is released from the hook portion 52*a* of the base 21, the wiper holder 50 rotates as described above. Then the resetting lever 51 rotates upward centering on the rotational bearing 50*a* of the wiper holder 50. At this juncture, since the guide surface 51*c* of the resetting lever 51 abuts upon the guiding portion 21*b* arranged for the base 21, the resetting lever 51 rotates centering on the resetting lever rotational shaft 50*b* of the wiper holder 50 in the direction opposite to the wiper holder 50. The rotations of the wiper holder 50 and resetting lever 51 terminate when the abutting portion 51*b* of the resetting lever 51 and the resetting lever abutting surface 50*e* of the wiper holder 50 are in contact with each other for locking.

Figure 7:
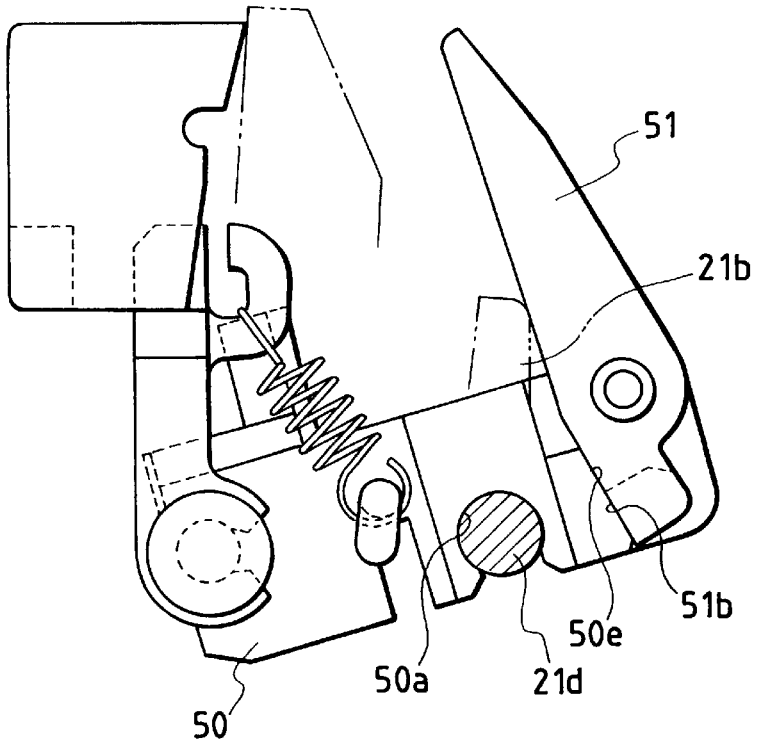
FIG. 7 is a rear view which shows a state that the rotations of a wiper holder and resetting lever are completed.

FIG. 7 is a rear view which shows a state where the rotations of the wiper holder and resetting lever terminate.

When the rotations terminate, the leading end of the resetting lever in a state shown in FIG. 3 is not in the intervening position as shown in FIG. 6 with respect to the resetting lever hooking arm 2*a* of the carriage 2. However, in a state shown in FIG. 7, the resetting lever is raised so that its leading end reaches the intervening position.

The resetting of the wiper holder 50 in the state shown in FIG. 7 to the state shown in FIG. 3 is performed by the rotation of the wiper holder 50 in the restoring direction. This is possible by driving the carriage 2 to travel in the direction opposite to the scanning direction at the time of the wiping having been executed, thus allowing the leading end of the resetting lever 51 to be hooked to the resetting lever hooking arm 2*a* of the carriage 2.

FIGS. 8A to 8D are rear views (observed in the direction indicated by an arrow (1) in FIG. 1) which schematically illustrate each of the steps of setting and resetting operations of the wiper 16 by use of the wiping mechanism described earlier in conjunction with FIG. 5 to FIG. 7. Here, each of the arrows in FIGS. 8A to 8D indicates the traveling direction of the carriage.

Figure 8A:
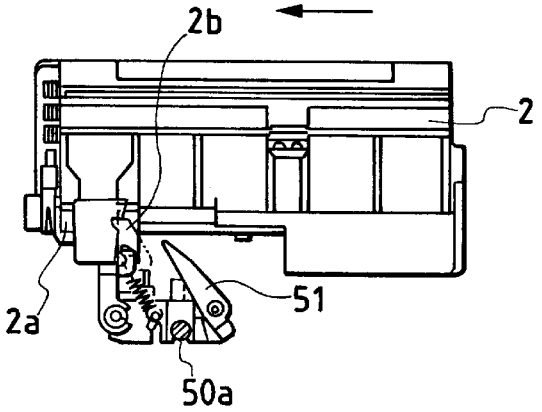
FIGS. 8A to 8D are rear views schematically showing each step of setting and resetting operations of the wiper of the wiping mechanism illustrated in FIG. 5 to FIG. 7 (in the state observed in the direction indicated by the arrow (1) in FIG. 1).
Figure 8B:
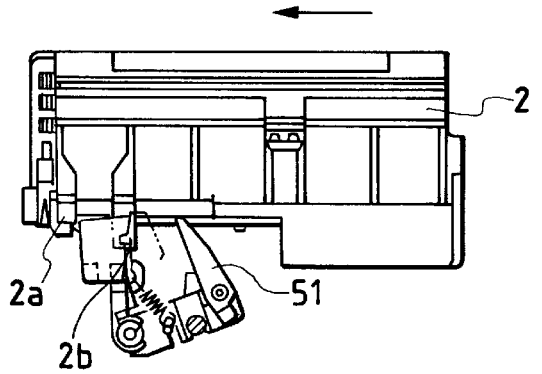
Figure 8C:
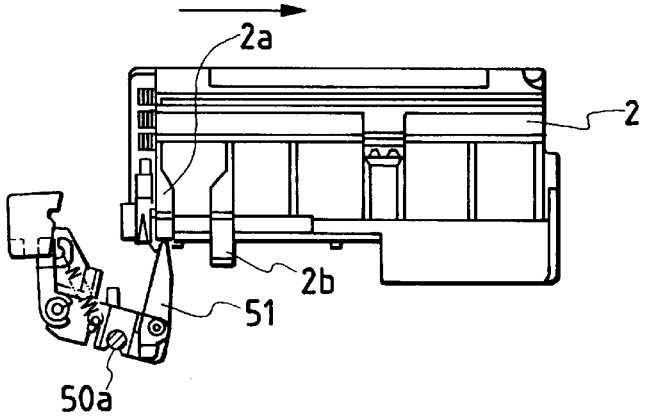
Figure 8D:
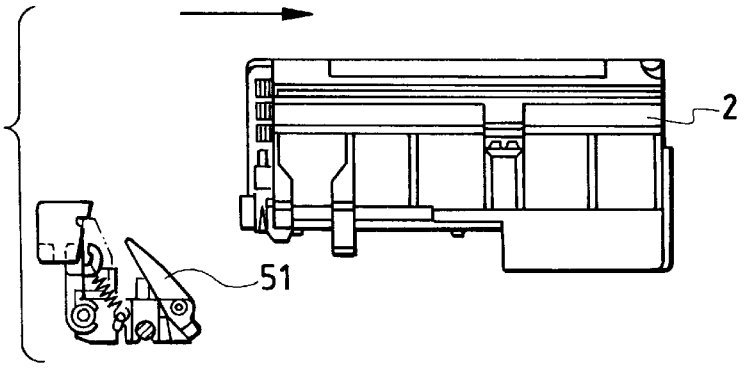
Figure 9A:
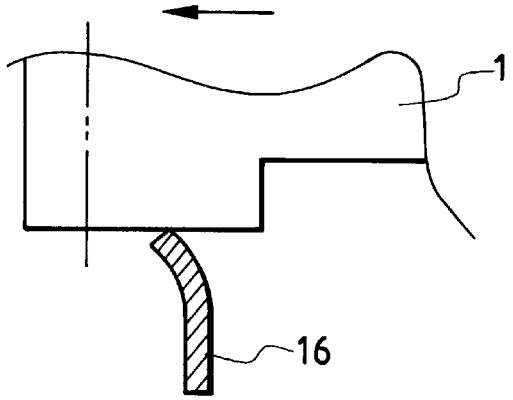
FIGS. 9A to 9C are views schematically showing the positional relationship between the wiper and recording head in each position of the respective steps shown in FIGS. 8A to 8D.
Figure 9B:
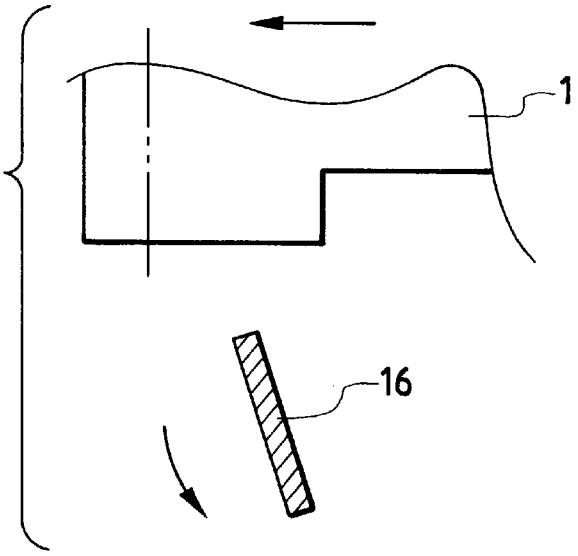
Figure 9C:
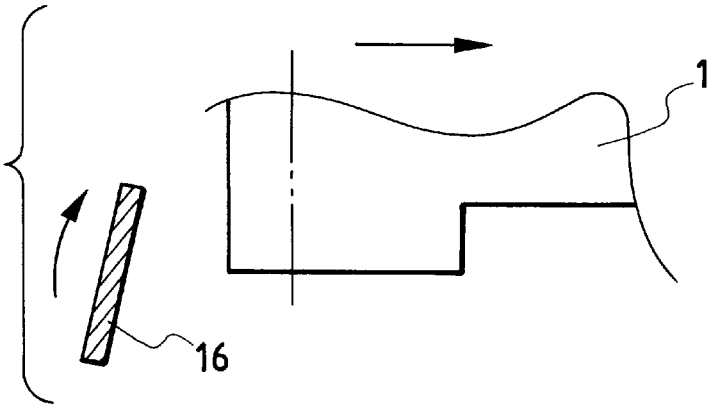

FIGS. 9A to 9C are views schematically showing the positional relationship between the wiper and recording head in each of the steps shown in FIGS. 8A to 8D.

The state shown in FIG. 8A is such that from the position of the carriage 2 in the recording area, the carriage 2 travels to the non-recording area where the wiper 16 is present so that the wiping operation is actuated, that is, the moment the wiper begins to part from the recording head 1 (see FIG. 1), which is the same state as illustrated in FIG. 5 showing the moment the latch lever abutting arm 2*b* of the carriage 2 is just in contact with the abutting portion 52*d* of the latch lever 52. After that, the wiper 16 and recording head 1 are in the wiping condition illustrated in FIG. 9A.

The state shown in FIG. 8B is such that the carriage 2 further advances from the state shown in FIG. 8A in the direction indicated by an arrow, thus the wiper holder 50 being caused to rotated by means of the wiping mechanism described above, and the wiper 16 being in a state that it parts from the recording head 1 (see FIG. 1). This is the same state as shown in FIG. 7. Then the wiper 16 and recording head 1 are in a state as shown in FIG. 9B where these members are completely apart from each other.

Since the wiping terminates in the position of the carriage 2 as shown in FIG. 8B, the carriage 2 is driven to travel in the direction opposite to the direction in which it has traveled so that the wiper 16 is returned to the initial state as shown in FIG. 5. Then the leading end of the resetting lever 51 is raised to the intervening position with respect to the resetting lever hooking portion 2*a* of the carriage 2.

Therefore, latch lever 51 is pressed to the traveling direction of the carriage. At that time, the abutting portion 5*b* of the latch lever 51 is in the position where it is in contact with the resetting lever abutting portion 50*e* of the wiper holder 50. Hence the latch lever 51 and wiper holder 50 begin to rotate centering on the rotational bearing 50*a* of the wiper holder 50 (see FIG. 7).

Then, when the carriage 2 travels further, the lowermost face of the resetting lever hooking portion 2*a* of the carriage 2 abuts upon the leading end of the latch lever 51 (FIG. 8C).

In the state shown in FIG. 8C, the lowermost face of the resetting lever hooking portion 2*a* of the carriage 2 abuts upon the leading end of the latch lever 51, and the position of the wiper 16 with respect to the recording head 1 is returned to the initial wiping position. However, since the returning position of the wiper 16 is set at a location where the carriage 2 travels to the position in which the recording head 1 and wiper 16 are not in contact with each other. Therefore, any wiping operation is actuated (FIG. 9C).

When the carriage travels further from the state shown in FIG. 8C, the contact between the lowermost face of the resetting lever hooking portion 2*a* of the carriage 2 and the leading end of the latch lever 51 is released. Then, the wiper holder 50 begins to rotate centering on the rotational bearing 50*a* of the wiper holder 50 by the application of force generated by the latch spring 54 tensioned between the latch lever and the wiper holder 50. At that time, the latch lever 52 drops from the state shown in FIG. 8C while the guide portion 52*b* of the latch lever 52 is being pressed to the wall of the latch portion 21*a* of the base 21 by the spring force. Hence the hooking portion 52*a* of the latch lever 52 abuts upon the latch portion 21*a* of the base 21 to present the initial state.

Figure 10:
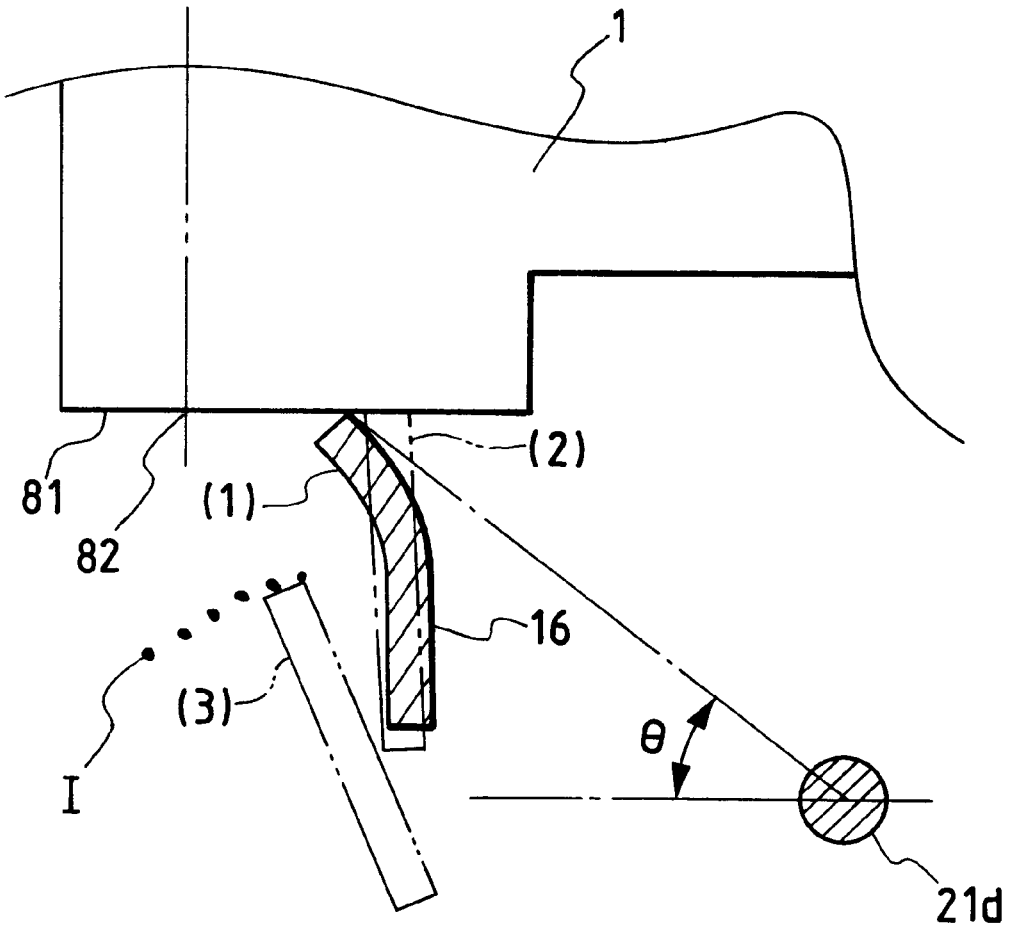
FIG. 10 is a view which schematically shows the locus of the wiper from the state illustrated in FIG. 8A to the state illustrated in FIG. 8B.
Figure 11:
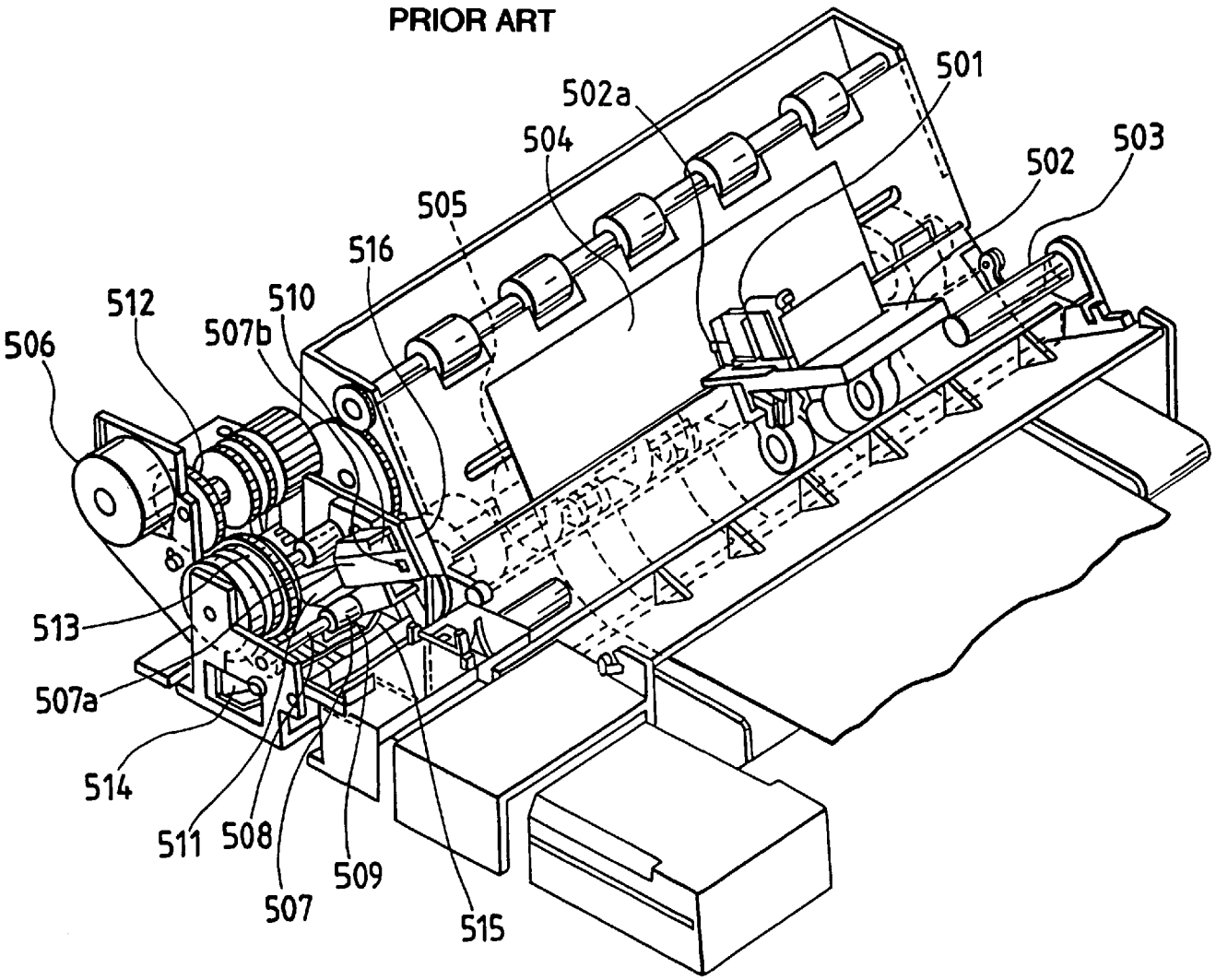
FIG. 11 PRIOR ART
FIG. 11 is a perspective view which shows the structure of a principal part of a generally used ink jet recording apparatus provided with a suction recovery device.

FIG. 10 is a view which shows the locus of the wiper that reaches the state shown in FIG. 8B from the state shown in FIG. 8A.

When the carriage 2 is in the position shown in FIG. 8A, the wiper 16 presents a state that it is bent as indicated by a mark (1).

Then the wiper 16 rotates centering on the rotational shaft 21*d* of the base 21. At that time, the bent shape of the wiper 16 is smoothly restored to the straight shape by this rotation. It is then in a state indicated by the mark (2).

As a result, ink does not substantially fly and spread from the leading end of the wiper by the restoring force of the wiper 16 as in the case of the prior art where it is arranged to draw the wiper 16 downward straightly from the state indicated by the mark (1).

An angle θ is formed by the line drawn between the leading end of the wiper 16 and the center 21*d* of the rotational shaft of the wiper 16, and the horizontal line of the center 21*d* of the rotational shaft (which is in parallel to the traveling direction of the carriage, running through the center 21*d* of the rotational shaft). This angle is optimally formed within a range of 45 to 90 degrees. If the angle θ is less than that within such optimal range, the condition becomes equivalent to the case where the wiper 16 is drawn straightly downward. Therefore, ink may fly and spread due to the restoring force of the wiper.

The flying and spreading of ink due to the wiping operation by means of such structure as described above are caused by the rotation of the wiper holder 50 performed by the application of the spring force of the latch spring 54 when the wiper 16 parts from the recording head 1 during the shift from the states shown in FIG. 8A to FIG. 8B. Although the rotation of the wiper holder 50 terminates when the abutting portion 51*b* of the resetting lever 51 is in contact with the resetting lever abutting surface 50*e* of the wiper holder 50, a shock is carried over to the leading end of the wiper the moment the rotation of the wiper holder 50 stops, because the time during which the rotation of the wiper begins and ends is instantaneous. Then, as shown in FIG. 10 with an indication (3), ink adhering to the leading end of the wiper 16 flies in the direction (opposite to the recording area) indicated by a reference mark I, which is opposite to the direction in which ink flies and spreads due to the restoring force of the wiper hitherto arranged.

In this respect, the description has been made of the present invention by exemplifying a printer having an ink jet recording head mounted on a carriage as the embodiment described above, but it is possible to preferably apply the invention even to an information processing apparatus capable of reading image information from a source document supported by a platen by arranging a scanner whose outer configuration is substantially the same as the ink jet recording head, and mounting it on the carriage compatibly with the ink jet recording head, for example.

Furthermore, as modes of recording apparatuses in accordance with the present invention, it may be possible to adopt such modes as a copying apparatus combined with a reader, and a facsimile apparatus provided with the functions of transmission and reception, in addition to those of the image output equipment integrally or individually arranged for a word process, computer, or some other information processing apparatuses.

In accordance with the present invention, cleaning means is rotatively arranged in the traveling direction of a carriage, and after cleaning a recording head, the cleaning means parts from the recording head, while rotating in the traveling direction of the carriage. It is further arranged that cleaning means is restored to the cleaning position thereafter without abutting upon the recording head. Therefore, there is no possibility that ink flies and spreads in the direction toward the printing area the moment the wiping member parts from the recording head. Also, it is arranged to perform the operation for parting the wiping member from the recording head following the traveling operation of the carriage. As a result, the structure can be formed simply without extra costs, while it is made possible to operate wiping the discharge port surface of the recording head reliably, while keeping the width of the apparatus main body in a small dimension.

What is claimed is:

1. An ink jet recording apparatus, comprising:

a carriage for causing a recording head provided with discharge ports for discharging ink to travel by mounting said recording head on said carriage;

a wiping blade for wiping a discharge boot surface of said recording head having said discharge ports arranged therefor; and holding means for rotatively holding said wiping blade in a traveling direction of said carriage at the time of said discharge port surface being wiped by said wiping blade.

2. An ink jet recording apparatus according to claim 1, wherein said wiping blade is arranged so that an angle formed by a line connecting the surface of said wiping member abutting upon said recording head with the center of said rotational shaft of said wiping member, and a line being in parallel to the traveling direction of said carriage and running through the center of said rotational shaft is made 45 to 90 degrees.

3. An ink jet recording apparatus according to claim 1, wherein said holding means is provided with two levers, each being rotative individually, and one of said levers determines the contacting amount between said recording head and said wiping blade, and the other causes said wiping blade to return to its initial position.

4. An ink jet recording apparatus according to claim 1, wherein said recording head is provided with electrothermal transducing elements for generating thermal energy to be utilized as energy for discharing ink from said discharge ports.

5. An ink jet recording apparatus according to claim 4, wherein said recording head discharges ink from said discharge ports by utilizing film boiling created in ink by thermal energy applied by said electrothermal transducing elements.

6. An ink jet recording apparatus according to claim 1, wherein said holding means parts from said recording head by the rotation of said wiping blade after said discharge port surface is wiped by said wiping blade.

7. An ink jet recording apparatus according to claim 6, wherein said holding means is returned to the initial position without abutting upon said recording head after said wiping blade parts from said recording head.

8. An ink jet recording apparatus according to claim 1, wherein the traveling direction of said carriage at the time of said discharge port surface being wiped by said wiping blade is the direction in which said recording head is away from the recording area where recording is performed by said recording head.

9. An ink jet recording apparatus according to claim 1, wherein said wiping blade is a flexible blade.

10. A wiping method for an ink jet recording apparatus provided with a recording head having discharge ports for discharging ink, the discharge port surface having said discharge ports being arranged for being wiped by a wiping blade, comprising the following step of:

causing said wiping blade to part from said recording head by the rotation of said wiping blade in a traveling direction of said recording head when said discharge port surface is wiped by said wiping blade.

11. A wiping method for an ink jet recording apparatus according to claim 10, wherein said wiping blade returns to its initial position without abutting upon said recording head after parting from said recording head.

12. A wiping method for an ink jet recording apparatus provided with a recording head having discharge ports for discharging ink, the discharge port surface having said discharge ports being arranged for being wiped by a wiping blade, comprising the following step of:

causing said wiping blade to part from said recording head by the rotation of said wiping blade in a moving direction of said recording head with respect to said wiping blade when said discharge port surface is wiped by said wiping blade.

13. A wiping method for an ink jet recording apparatus provided with a recording head having discharge ports for discharging ink, the discharge port surface having said discharge ports being arranged for being wiped by a wiping blade, comprising the following step of:

causing said wiping blade to part from said recording head by the rotation of said wiping blade in a bending direction of said wiping blade when said discharge port surface is wiped by said wiping blade.

14. An ink jet recording apparatus, comprising:

a carriage for causing a recording head provided with discharge ports for discharging ink to travel by mounting said recording head on said carriage;

a wiping blade for wiping a discharge port surface of said recording head having said discharge ports arranged therefor; and holding means for rotatively holding said wiping blade in a moving direction of said carriage with respect to said wiping blade at the time of said discharge port surface being wiped by said wiping blade.

15. An ink jet recording apparatus, comprising:

a carriage for causing a recording head provided with discharge ports for discharging ink to travel by mounting said recording head on said carriage;

a wiping blade for wiping a discharge port surface of said recording head having said discharge ports arranged therefor; and holding means for rotatively holding said wiping blade in a bending direction of said wiping blade at the time of said discharge port surface being wiped by said wiping blade.

* * * * *

UNITED STATES PATENT AND TRADEMARK OFFICE

CERTIFICATE OF CORRECTION

PATENT NO. : 5,917,517

DATED : June 29, 1999

INVENTORS : AKIRA KIDA et al.

It is certified that error appears in the above-identified patent and that said Letters Patent is hereby corrected as shown below:

COLUMN 2

Line 17, ".ports" should read --ports--.

COLUMN 7

Line 51, "(a)," should read --(α),--.

COLUMN 11

Line 29, "member" should read --blade--.

Line 30, "member," should read --blade,--.

Signed and Sealed this

Twenty-first Day of December, 1999

*Attest:*

Q. TODD DICKINSON

*Attesting Officer*

*Acting Commissioner of Patents and Trademarks*